US009126205B2

(12) United States Patent
Mohanty et al.

(10) Patent No.: US 9,126,205 B2
(45) Date of Patent: Sep. 8, 2015

(54) AUTOMATED SYSTEM FOR COAL SPIRAL

(71) Applicant: Board of Trustees, Southern Illinois University, Carbondale, IL (US)

(72) Inventors: Manoj K. Mohanty, Carbondale, IL (US); Ajay Mohan Mahajan, North Canton, OH (US); Haibo Wang, Carbondale, IL (US); Baojie Zhang, Amherst, NY (US)

(73) Assignee: Board of Trustees, Southern Illinois University, Carbondale, IL (US)

( * ) Notice: Subject to any disclaimer, the term of this patent is extended or adjusted under 35 U.S.C. 154(b) by 0 days.

(21) Appl. No.: 14/267,596

(22) Filed: May 1, 2014

(65) Prior Publication Data

US 2014/0238906 A1 Aug. 28, 2014

Related U.S. Application Data

(60) Provisional application No. 61/818,242, filed on May 1, 2013.

(51) Int. Cl.
*B03B 5/62* (2006.01)
*B03B 13/00* (2006.01)

(52) U.S. Cl.
CPC ..... *B03B 5/626* (2013.01); *B03B 13/00* (2013.01)

(58) Field of Classification Search
CPC ..... B03B 13/00; B03B 5/626; B07B 2230/00
USPC ..... 209/362, 434, 459, 697
See application file for complete search history.

(56) References Cited

U.S. PATENT DOCUMENTS

| | | | | | |
|---|---|---|---|---|---|
| 2,615,572 | A * | 10/1952 | Hodge | 209/454 |
| 2,700,469 | A * | 1/1955 | Humphreys | 209/459 |
| 2,952,360 | A * | 9/1960 | Oberg | 209/18 |
| 3,235,079 | A * | 2/1966 | Hendrickson | 209/459 |
| 3,235,080 | A * | 2/1966 | Schwartz | 209/459 |
| 3,235,081 | A * | 2/1966 | Hendrickson | 209/459 |
| 4,553,673 | A * | 11/1985 | Wright | 209/697 |
| 5,472,096 | A * | 12/1995 | Prinsloo | 209/459 |
| 6,156,030 | A * | 12/2000 | Neev | 606/10 |
| 2006/0180525 | A1 * | 8/2006 | Watters et al. | 209/728 |
| 2007/0075002 | A1 * | 4/2007 | Watters et al. | 209/711 |
| 2011/0186487 | A1 * | 8/2011 | Cooke | 209/459 |

* cited by examiner

*Primary Examiner* — Shogo Sasaki
(74) *Attorney, Agent, or Firm* — Mark E. Stallion; Husch Blackwell LLP

(57) ABSTRACT

An apparatus and method for sensor and control system, which automatically adjusts a product splitter position of a full-scale spiral. An electrical conductivity-based automation system is described and claimed herein and has been successfully developed and demonstrated as illustrated herein. The system includes a sensor and a microprocessor based and controlled servo or gear motor that is utilized to adjust the splitter of an operating coal/mineral spiral based on the readings of the sensor. The device as described and claimed herein converts a traditional coal spiral to an automated system for controlling the splitter thereby giving the spiral unit the ability to automatically adjust a key process variable, i.e., its splitter position, in real time as and when the feed coal or other mineral property changes to maintain the performance of the spiral at the optimum level.

10 Claims, 14 Drawing Sheets

| Compound spiral Tests | $D_{50}$ | $E_p$ | By-pass to Product | By-pass to Tailing |
|---|---|---|---|---|
| Compound 1-1 | 1.72 | 0.11 | 5.82 | 0.87 |
| Compound 1-2 | 1.73 | 0.11 | 3.93 | 1.86 |
| Compound 1-3 | 1.73 | 0.13 | 6.70 | 1.78 |
| Compound 1-4 | 1.72 | 0.12 | 6.55 | 1.53 |
| Compound 2-1 | 1.64 | 0.10 | 2.19 | 1.80 |
| Compound 2-2 | 1.64 | 0.12 | 1.27 | 3.30 |
| Compound 2-3 | 1.65 | 0.12 | 1.30 | 2.57 |
| Compound 2-4 | 1.64 | 0.11 | 1.75 | 2.88 |

Figure 7

| PCB State | Switch Position | Function |
|---|---|---|
| OFF | 1 | Solenoids OFF |
| | 2 | Solenoids ON |
| ON | 1 | PCB control |
| | 2 | Solenoids ON |

Figure 9B

| Switch 1 | Switch 2 | Operation |
|---|---|---|
| **OFF (0)** | OFF (0) | Memory Read and Erase |
| **OFF (0)** | ON (1) | Coal Type 1 |
| **ON (1)** | OFF (0) | Coal Type 2 |
| **ON (1)** | ON (1) | Coal Type 3 |

Figure 9C

AUTOMATED SYSTEM FOR COAL SPIRAL

CROSS REFERENCE

This application claims priority to and the benefit of U.S. Provisional application 61/818,242 entitled Automated System For Coal Spiral filed May 1, 2013, which is hereby incorporated by reference in its entirety.

BACKGROUND

1. Field

This technology relates generally to coal and/or mineral spirals and, more particularly, to splitter controls for coal spirals.

2. Background Art

Spiral concentrators have been utilized in the mineral industry for treatment of chrome-bearing sands since the 1940's. In the 1950's it was demonstrated that reasonable separation between low ash clean coal and high ash mineral matter could be achieved using coal spirals. Coal spirals are widely used in coal preparation plants around the world to clean fine coal, typically in the particle size range of 1×0.15 mm. Recent studies also report that high efficiency separation can be obtained for fine coal cleaning having a particle size as small as 45 microns. A spiral concentrator is a flowing film separator in which the lightest particles move to the outermost section of the spiral profile, whereas the heaviest particles remain in the inner most section. There are usually two splitters at the discharge end of a coal spiral to produce three product streams (i.e. clean coal product, middlings, and tailings respectively). The splitter position which decides the clean coal yield and product quality, is typically set at one point during the initial installation and is rarely moved again, and if it is moved it is performed manually. This results in a significant loss of clean coal to the tailings stream with fluctuating feed characteristics.

The major factors which have made spiral concentrators so popular include low capital investment and low operating costs and there are no requirements for chemical reagent or dense medium. Despite their popularity and the trend toward increased automation in modern coal preparation plants, adjustments to the controllable process variable for coal spirals, i.e., product splitter position, continue to be done (if at all) manually. Since spiral feed in a plant tends to fluctuate on a regular basis, due to the change in run-of-mine coal characteristics, suitable manual adjustment of splitter position in tens or hundreds of spirals operating in a plant is nearly impossible. As a result, the clean coal yield from a spiral and also the overall plant suffer on a regular basis. There can be a significant variation in spiral feed ash content and spiral feed solid content. These fluctuations in feed resulted in a significant change in spiral performance, which can be described by a variation in product ash content over the range of 7.75% to 12.95% and clean coal yield from 62.41% to 82.72% for a specific operating plant.

A comprehensive coal preparation plant of the modern day consists of four cleaning circuits, utilized to clean coal of different sizes which range from 100 mm (4 inch) to 0. If one were to name these circuits by the size of the coal they clean, these four circuits could be teemed as coarse, intermediate, fine and ultrafine coal cleaning circuits. It is the fine coal circuit that utilizes spiral concentrator as the coal cleaning technology in most of the plants. Nearly 6 to 7% of the coal produced worldwide go through the spiral cleaning process in coal processing plants.

Traditionally spiral concentrators separate clean coal from ash forming mineral rejects using the general principle of flowing film separation in the particle size range of 1×0.15 mm. The product/reject splitter is a key performance controller of a conventional coal spiral. The quantity and quality of clean coal produced from a spiral concentrator is directly dependent on the splitter position, i.e., how far the splitter is positioned from the central column on the spiral trough. Spiral splitters position is adjusted manually when a significant change in the feed coal characteristics (include, solid/liquid content, ash content, sulfur content, washability etc.) is expected to occur to continue producing the same incremental quality clean coal. However, an average size plant has to have a lot of these spirals to clean the entire fine coal since spiral is a low capacity processing unit. Also, because of the large relative foot print they take, spiral banks in a plant are typically very tightly packed with the individual spirals. Thus, the manual adjustment of spiral splitters, although physically possible, is rarely ever done after the initial installation of the plant. This leads to loss of clean coal which could have been recovered with the due adjustment of the splitter position in a timely manner.

BRIEF SUMMARY

The invention comprises sensor and control system to automatically adjust the product splitter position of a full-scale spiral. An electrical conductivity-based automation system is described and claimed herein and has been successfully developed and demonstrated as illustrated herein. The system includes a sensor and a microprocessor (or micro-controller) based circuit and controlled motor (the motor can be a servo motor or DC gear motor or other comparable motor for the application) that is utilized to adjust the splitter of an operating coal spiral based on the readings of the sensor. The device as described and claimed herein converts a traditional coal spiral to an automated system for controlling the splitter thereby giving the coal spiral unit the ability to automatically adjust a key process variable in real time as and when the feed coal property changes. The device can also be used for minerals in addition to coal including iron, heavy mineral sands and other minerals. Therefore, for the purposes of this application, the methods and apparatus described for use with coal and/or minerals herein can be used for both coal and for minerals.

Basic properties of coal slurry are utilized for their on-line measurability and their correlation with the constituent solid density of the slurry. An electrical conductivity (i.e., reciprocal of resistivity) based proprietary sensing technique (resistivity type sensor), has been selected for measuring solids density of particles in the spiral trough. Two sensors can be used to establish a density gradient in the critical region across the spiral trough at the discharge end. Based on this continuously monitored density gradient, a PIC24 microcontroller can be programmed to send a signal to a motor, for example a DC gear motor or a servo motor, that would move the splitter arm when sufficient variation in conductivity is detected. Various other microcontrollers can be utilized that are comparable and sufficient for the task. A cycle time can be used for the spiral control system; and the cycle time can be lengthened to about approximately 30 or 60 minutes. With a compound spiral programmed to achieve a specific gravity of separation at 1.65, the actual $D_{50}$ values achieved for several tests were in the range of 1.64 and 1.73. By attaching the device as described and claimed herein, as a Smart Spiral Component (SSC), to a conventional coal spiral concentrator, the resulting coal spiral can be referred to as a "smart spiral".

The smart spiral's splitter position can be automatically adjusted in real time by the attached SSC whenever a feed fluctuation occurs to avoid the abovementioned clean coal loss. In another configuration more than two sensors can be used and in yet another configuration a single sensor can be used.

The spiral automation system operates on the principle that the electrical conductivity of solid particles is different for different types of solid materials. It is well known that the specific gravity of coal is linearly correlated to its ash content; the higher the specific gravity, the higher the ash content. It is also well established that coal ash content is a function of mineral matter content. Considering the fact that electrical conductivity of most mineral matter is much higher than that of carbonaceous matter present in coal, a direct correlation between electrical conductivity and specific gravity of coal was established, refer to FIG. 13. Low ash content correlates to a cleaner coal. In other words, the higher the ash content, the higher the mineral matter, therefore, the higher the specific gravity, which means a less clean coal. These conductivity measurements can be made on the solid sample collected from different sections across the trough of a full-scale spiral in operation.

For one configuration of the system disclosed and claimed the system can be an automation system, which includes two conductivity-based sensors, a PIC microcontroller, two tabular solenoids, and a splitter box with a vertical splitter controlled by a DC gear motor that moves inward or outward to maintain a constant specific gravity cut point. The sensor consists of two stainless steel rings connected to two Plexiglas tubes. The two sensors are used to establish the conductivity gradient and thus, the density gradient in the critical region (about 7 inch long) across the spiral trough at the discharge end. A PIC24 microcontroller can be used to then send a signal to the DC gear motor to turn clockwise or counter-clockwise or stay at the same position based on the difference between the conductivity/density measurement of the present cycle and that of the previous cycle. The automation system has been validated by examining the performance of a full-scale spiral while deliberately changing factors like feed solid content, feed washability characteristics, and feed slurry ionic concentration. With compound spirals programmed to achieve a specific gravity of separation at 1.65, actual $D_{50}$ values achieved for two separate tests were 1.64 and 1.73, respectively. The close proximity of target and actual $D_{50}$ values is indicative of the effectiveness of the automated spiral control system.

Another configuration of a system for controlling a splitter of a spiral concentrator includes a constituent solid density sensor sensing characteristics of a constituent solid density of mineral slurry channeled through a spiral concentrator. The sensor can output a constituent solid density gradient output signal indicative of a constituent solid density gradient across a spiral trough of the spiral concentrator based on the sensed characteristics. A micro-controller having connectivity to the sensor can receive the constituent solid density gradient output signal indicative of the constituent solid density gradient across the spiral trough of the spiral concentrator. The microcontroller can have program logic, which interprets the constituent solid density gradient output signal indicative of the constituent solid density gradient and calculates a specific gravity of separation and correlates the specific gravity of separation to a splitter position along the spiral trough to achieve the specific gravity separation for the mineral slurry channeled through the spiral concentrator. The microcontroller can output an output motor control signal representative of the splitter position. A motor can have a motor controller having connectivity the microcontroller and can receive from the microcontroller the output motor control signal. When received, it can control the motor to move a splitter to the splitter position along the spiral trough based on the motor control signal thereby separating the mineral slurry channeled through the spiral concentrator at the specific gravity of separation.

In one configuration the constituent solid density sensor can be an electrical conductivity sensor and where the sensing of characteristics of a constituent solid density of a mineral slurry channeled through a spiral concentrator is measuring an electrical conductivity of the mineral slurry and where the constituent solid density gradient output signal indicative of the constituent solid density is based on the electrical conductivity measurement. The electrical conductivity sensor can include at least two electrical conductivity sensors space apart across the spiral trough, where each of the electrical conductivity sensors comprise sampling tubes where each sampling tube has two spaced apart conductive rings positioned inside each of the sampling tubes and attached along an interior wall of each sampling tube. One of the two space apart conductive rings in each of the sampling tubes can send an input voltage to a sample of mineral slurry within each of the sampling tubes and the other of the two space apart conductive rings in each of the sampling tubes can sense the current between the two spaced apart rings based on the conductivity of the sample of mineral slurry. The at least two sampling tubes can be space across the spiral trough of the spiral concentrator at an exit of the spiral concentrator, and at least one of the at least two sampling tubes can be attached to the splitter.

One method for automating a coal spiral can include sensing characteristics of a constituent solid density of a mineral slurry being channeled through a spiral concentrator. A microcontroller can perform the step of sending a constituent solid density gradient output signal indicative of a constituent solid density gradient across a spiral trough of the spiral concentrator based on the sensed characteristics. The microcontroller can perform the step of receiving at a microcontroller the constituent solid density gradient output signal indicative of the constituent solid density gradient across the spiral trough of the spiral concentrator. The microcontroller can perform the step of interpreting the constituent solid density gradient output signal indicative of the constituent solid density gradient. The microcontroller can further perform the step of calculating at the microcontroller a specific gravity of separation and correlating the specific gravity of separation, to a splitter position along the spiral trough to achieve the specific gravity separation for the mineral slurry channeled through the spiral concentrator; and further perform the step sending an output motor control signal representative of the splitter position. Receiving the output motor control signal and when received, controlling the motor to move a splitter to the splitter position along the spiral trough based on the motor control signal thereby separating the mineral slurry channeled through the spiral concentrator at the specific gravity of separation.

One embodiment for sensing of characteristics of a constituent solid density of a mineral slurry channeled through a spiral concentrator can include measuring an electrical conductivity of the mineral slurry and where the constituent solid density gradient output signal indicative of the constituent solid density is based on the electrical conductivity measurement. Measuring electrical conductivity can further include filling a sample tube with a sample of the mineral slurry channeled through the spiral concentrator, where the sampling tube includes two spaced apart conductive rings positioned inside the tube and attached along an interior wall of the sampling tube; sending an input voltage through one of the two space apart conductive rings in the sampling tube to a sample of mineral slurry within the sampling tube Presently, the coal industry does not address this problem with an automation system as described and claimed herein and no such system is commercially available to adjust the splitter position in a coal spiral as described and claimed. These and other advantageous features of the present invention will be in part apparent and in part pointed out herein below.

BRIEF DESCRIPTION OF THE DRAWINGS

For a better understanding of the present invention, reference may be made to the accompanying drawings in which:

FIG. 7 is a table illustrating the effective separation;

FIG. 9B is a table illustrating solenoid control;

FIG. 9C is a table illustrating switch combinations for selecting coal type;

Figure 1A:
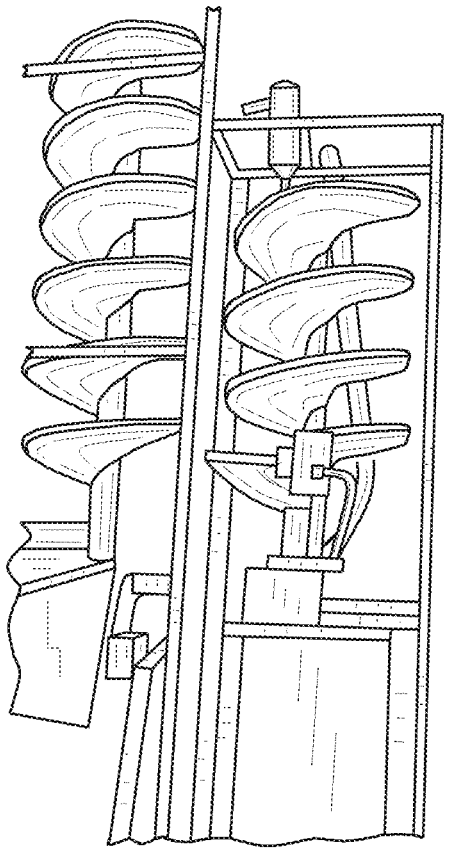
FIG. 1A is an illustration of a coal spiral.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION OF INVENTION

According to the embodiment(s) of the present invention, various views are illustrated in FIG. 1-13 and like reference numerals are being used consistently throughout to refer to like and corresponding parts of the invention for all of the various views and figures of the drawing. This application claims priority to and the benefit of U.S. Provisional application 61/818,242 entitled Automated System For Coal Spiral filed May 1, 2013, which is hereby incorporated by reference in its entirety.

One embodiment of the present technology comprising an electrical conductivity sensor adapted for measuring constituent solid density of particles in the spiral trough, where the sensor establishes a density gradient in the critical region across the spiral trough at or near the discharge end and further adapted for outputting a density gradient reading; and a microcontroller (for example a PIC24) programmed to receive and interpret the density gradient reading output and send a signal to a motor, for example a DC gear motor or servo motor or other comparable motor, that would move the splitter arm when sufficient variation in the density gradient reading output in conductivity is detected. The device and method described and claimed herein teaches a novel apparatus and method for automatically adjusting the splitter of a coal spiral or other mineral spiral in order to vary the value of the density gradient reading at which separation occurs.

Spiral concentrators are used in coal preparation plants to clean 1 mm×150 micron particle size coal fraction, which is too fine to be effectively cleaned by a heavy medium cyclone, but too coarse for froth flotation cells or flotation columns. Spiral is a flowing film separator in which the lightest particles (clean coal particles) move to the outermost section of the spiral profile, whereas the heaviest particles (ash forming mineral particles) remain in the inner most section. The splitter position, which decides the clean coal yield and product quality, is typically set at one point during initial installation and rarely adjusted again. This results in a significant loss of clean coal to the tailings stream with fluctuating feed characteristics and solid loading in the feed stream to the spiral. To explain, let's consider one splitter in the spiral profile. Actual experiments conducted at a pilot-scale research facility to illustrate this concept indicated a 20% reduction (from 75.9% to 55.9%) in clean coal yield to the product stream resulting due to a change in the feed solids content from 20% to 10%. A lower product ash content of 10.6% in comparison to 12.8% was caused due to the above reduction in feed solids content.

The reduction in clean coal yield and ash content was caused by a reduction in specific gravity of separation (density cut-point). It was possible to maintain clean coal yield at the original level of nearly 76% at an ash content of ~12.8% by a manual adjustment of the splitter position one step inward. Similar adjustments of the splitter position are required to maintain the same density cut-point to deal with many other fluctuations, commonly encountered in the mine and plant operating environment, which affect the feed flow rate, feed washability, distribution of feed flows in the spiral bank etc. Past studies (Abbott, 1982; Luttrell et al., 2000) indicate that it is essential to maintain the same density cut-point in each spiral in a spiral-bank to achieve the maximum yield from a spiral circuit.

The spiral automation system, which can generally be referred to as the Smart Spiral Component (SSC), operates on the principle that electrical conductivity of solid particles varies with different types of solid materials. Clean coal particles are generally less conductive than inorganic mineral particles. In fact, a $2^{nd}$ order polynomial relationship between electrical conductivity and solid density can be successfully fitted to experimental data indicating that higher density materials resulted in higher electrical conductivity or, in other words, lower electrical resistivity. The SSC can include two conductivity-based sensors, conductivity measurement circuitry, a PIC microcontroller, two tabular solenoids, a DC motor, and a splitter box. Each of the two sensors can comprise two stainless steel rings placed inside a sampling tube, equipped with a bottom plug controlled by a solenoid for capturing and measuring the electrical conductivity of a sample.

Figure 13:
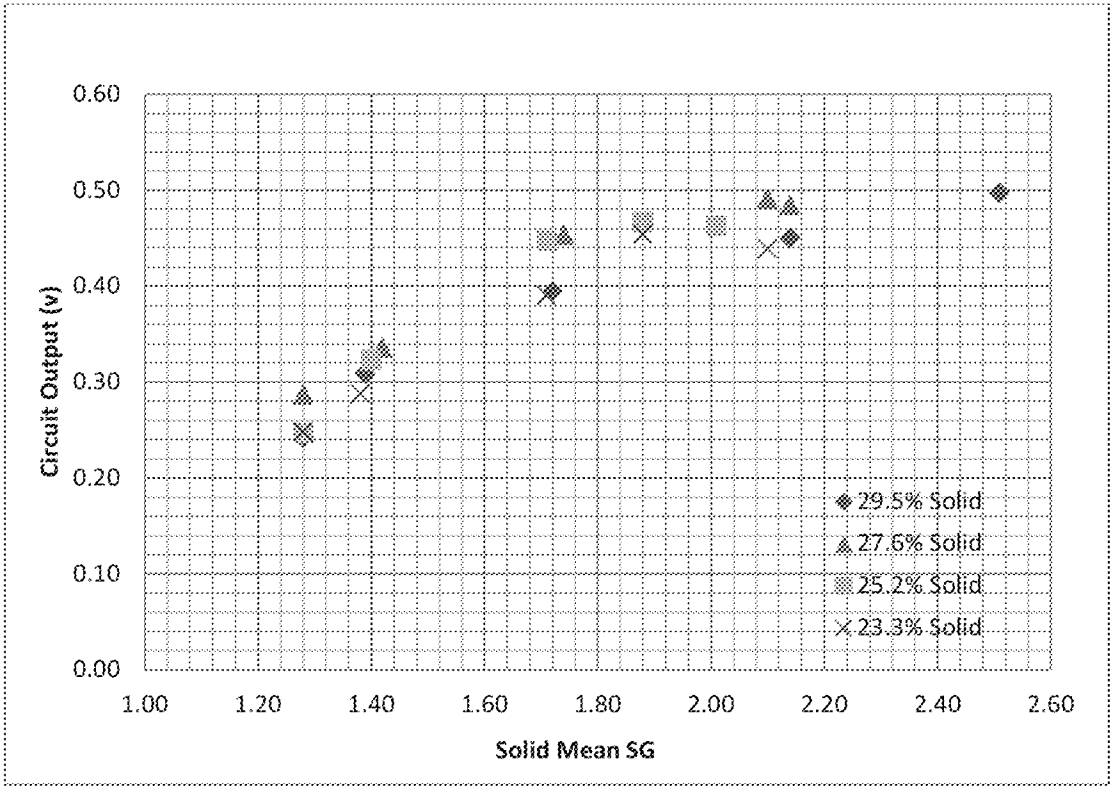
FIG. 13 is graphical illustration of the correlation of electrical conductivity and solid density.

The two sensors can used to establish the density gradient in the critical region (about approximately 7 inches) across the spiral trough at or near the discharge end. The conductivity of a two-phase (solid and liquid) suspension is a function of both solid conductivity and liquid conductivity. When measuring the conductivity of several different types of coal slurry with varying solids content and different types of solid materials in a series tests, it can be realized that it would be difficult to track solid conductivity and thus specific gravity (SG) of solids in the spiral trough without eliminating, or at least minimizing potential confounding factors such as liquid/solid content. Therefore, in one implementation of the technology it is decided to measure the conductivity of a packed bed of solids in a sensing tube instead of trying to measure the conductivity of the actual solid suspension. As shown in FIG. 13, good correlation can be found between output voltage and density of solids in a packed-bed sensing tube. These test results form the basis on which a self-emptying tube sensor system can be utilized to monitor the density gradient across the critical section of the spiral trough. These sensors measure the conductivity of a settled pack of solids, which is created during the short time period (a couple of minutes) when the bottom of sampling tube is plugged by turning off the solenoid. After the conductivity of the solid pack is measured in each sampling tube, the density gradient between the two measurement points across the spiral trough is established. Based on that measurement and the difference between it and the previous measurement, a PIC24 microcontroller actuates the DC gear motor to turn clock-wise or counter-clock-wise or to stay at the same position. Both solenoids are then turned on to empty the sampling tubes and complete one control cycle. The control cycle time for the spiral control system in a plant environment is about approximately 30 minutes, which can be varied as needed. It would be difficult to track solid conductivity and thus specific gravity (SG) of solids in the spiral trough without eliminating, or at least minimizing potential confounding factors such as liquid/solid content. Therefore, in one implementation the conductivity of a packed bed of solids is measured in the sensing sampling tube instead of trying to measure the conductivity of the actual solid suspension.

The optimum position for the splitter is a function of the amount of solids (solid loading) and total slurry (volumetric flow) on the spiral profile, as well as the type of coal (washability characteristics) being treated at a given point in time. Since these three conditions regularly fluctuate in a plant environment due to changes in the coal seam being mined and associated changes in quality and quantity of run-of-mine coal, the splitter position on the spiral trough should also change to maintain the maximum output.

Figure 5A:
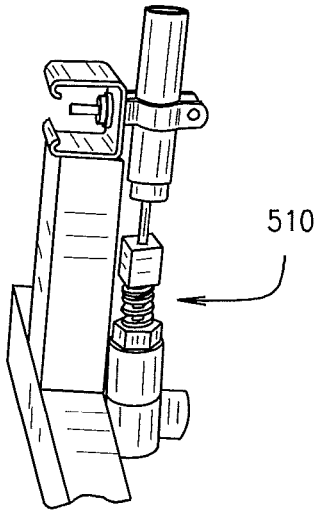
FIG. 5A is an illustration of the conductivity sensor tube/probe.
Figure 5B:
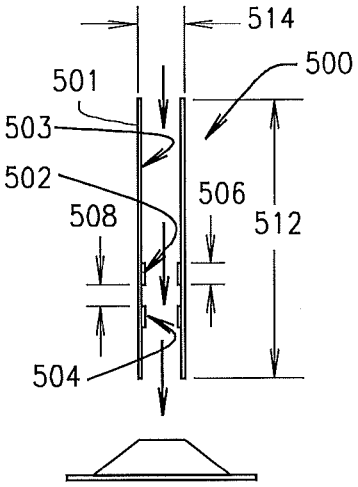
FIG. 5B is an illustration of the conductivity sensor tube/probe.
Figure 5C:
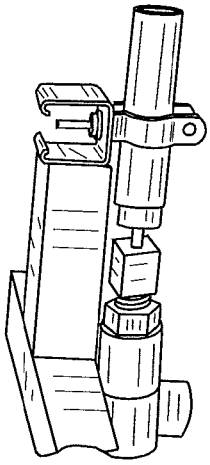
FIG. 5C is a further illustration of a tabular solenoid for sensing tube discharge control.

The tube sensor 500 developed can comprise a Plexiglas tube 501 and two stainless steel rings, 502 and 504, located within the tube 500, as seen in the sectional view of the tube 500 and shown in FIGS. 5A, 5B and 5C. The length and diameter of the tube for solids accumulation and discharge can be optimized. The optimum length 512 and diameter 514 can be determined by experimentation for a given material. The width of the ring 506 and the separation distance 508 between both rings affect the conductivity constant of the sensor, which determines its level of resolution. A tubular solenoid 510, as shown in FIG. 5, is used to control the sampling process, which consists of three phases: solids accumulation, data recording, and solids discharge. A tabular solenoid 510 is energized to discharge packed solids in about 5-10 seconds, then de-energized for solids to accumulate inside the tube and the sensing circuit to measure and record the conductivity of this packed bed of solids. Each of the electrical conductivity sensors comprise sampling tubes 501 where each sampling tube 501 has two spaced apart 508 conductive rings 502 and 504 positioned inside each of the sampling tubes 501 and attached along an interior wall 503 of each sampling tube 501 and where one of the two spaced apart conductive rings 502 and 504 in each of the sampling tubes sends an input voltage to a sample of the slurry within each of the sampling tubes and the other of the two spaced apart conductive rings in each of the sampling tubes senses a current between the two spaced apart conductive rings based on the conductivity of the sample of the slurry.

Based on this measurement and the amount of change from the previous measurement, the PIC microcontroller signals a DC gear motor, which moves the splitter. The measurement sensor can also be designed to be programmable and incorporate various sensors for moisture, vibration and electrical interference to add greater flexibility to the sensor and make the sensor more robust and adaptable even under various operating conditions. For example, a temperature sensor can be added to enable the system to sense temperature variations, which in many facilities can range from approximately 90° F. in summer to approximately 30° F. in winter and can affect conductivity readings even when other conditions remain the same. The temperature sensor can provide temperature readings to the microcontroller via a serial peripheral interface (SPI) where advanced splitter position control programs can compensate for temperature variation effects. See FIGS. 8 and 9 for an illustration of a sensor configuration and the manual switch configurations.

Also, the sensor stimulation circuit as shown can be designed to generate an elevated stimulation signal of about approximately $V_A$=1.15 V and f=250 Hz. The configuration can also provide for a selectable variable gain option. A selectable filter gain configuration can also be provided to improve noise performance. An averaging-8 operation can be performed during the ADC interrupt subroutine. Additional averaging filters can be implemented after ADC conversion in the microcontroller code.

The microcontroller program code can be configured to accommodate two, three or more different types of coal. Users can select coal types via two or more control switches mounted on the front panel of the system. Coal types corresponded to different switch combinations. The switch combinations for a three coal type configuration are listed in the table of FIG. 9C. When coal type remains the same, the fluctuation in the spiral feed is mostly due to the changes in the quantity of out-of-seam dilution and/or due to the quantity of coal mined. However, mineral composition in coal tends to stay the same and that is why the solid conductivity vs. density relationship (type shown in FIG. 13) remains nearly the same. When coal type changes, the mineral composition also tends to change and that would alter the conductivity vs. density relationship. That's why during the initial weeks/months of retrofitting existing spirals in a coal plant, a calibration curve describing the conductivity-density relationships for each of the coal types cleaned in a coal preparation plant is developed and programmed to the microcomputer. When the coal type changes during actual operation, the plant control room person will need to change the coal type switch to the appropriate coal so that the control system utilizes the right calibration curve to move the splitter to the right position.

The microcontroller program code can also be configured so that the splitter position is saved in flash memory when the system was turned off. This allows the system to start with the previous optimal splitter position once it is rebooted. Also, an additional averaging filter can be implemented in the microcontroller program code to achieve more stable splitter position control. The program code can also have built in flexibility for users to control cycle time and the calculation of new splitter positions.

Figure 4A:
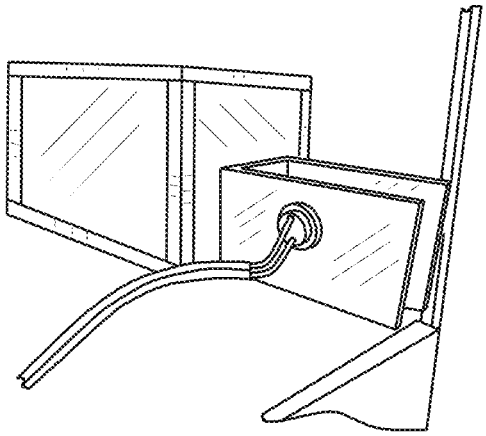
FIGS. 4A and 4B are an illustration of a SSC attached to a spiral.
Figure 4C:
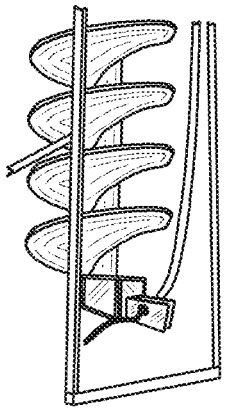
FIG. 4C is a splitter box positioned at the exit of a coal spiral.
Figure 4B:
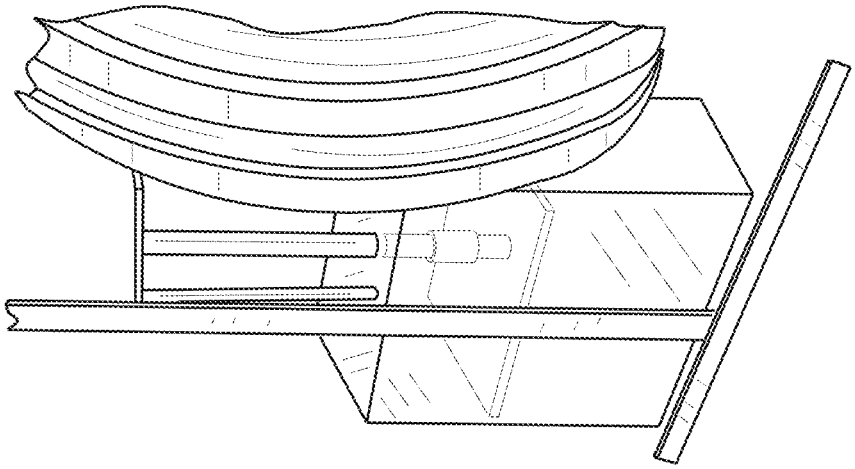

In one implementation a splitter box can comprise a housing big enough to fit the discharge end of a triple-start spiral, a splitter gate positioned on a gear rack to divide material flowing down the spiral into product and tailings, and two sensing channels to capture a portion of the flow from both upper and lower sections of the spiral trough. Refer to FIGS. 4A to 4C for an illustration of the implementation. FIGS. 4A and 4C are illustrations for a standard spiral concentrator and FIG. 4B illustrates the splitter adjustment with a triple start spiral concentrator.

Figure 2:
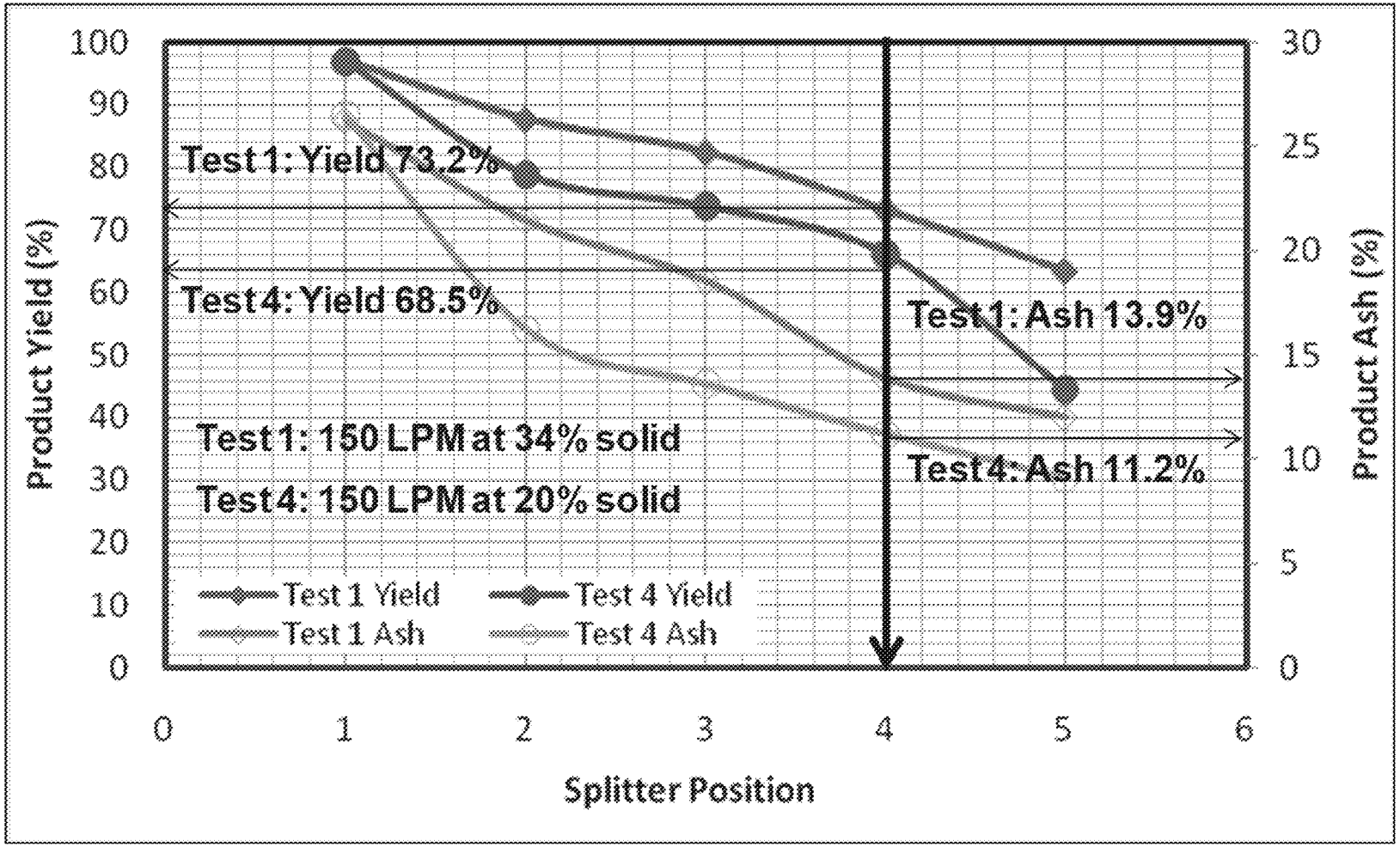
FIG. 2 is an illustration of the need for an automated system.

A set of experiments conducted using more realistic operating conditions for a coal spiral, as illustrated in FIG. 2, also confirms the need for an automatic adjustment of the splitter positions as and when a fluctuation in spiral feed occurs. As shown, a coal spiral provides (for Test 1) a clean coal yield of 73.2% at a product ash content of 13.9% with the splitter set at position 4 for the normal feed conditions, i.e., volumetric flow rate of 150 lpm (~39 gpm) and a solid content of 34%. For Test 4, when the feed solid content was lowered deliberately to 20% (the type of occurrence which happens quite often in a plant environment due to the stoppage of coal production from a specific section of the mine), while keeping the volumetric flow rate at the same level (of 150 lpm) as that of Test 1, the clean coal yield reduces by 4.7 percentage points to 68.5% level if the spiral splitter continues to be set at the position 4. It may be noted that this will also result in a more favorable product ash content of 11.2%, which is 2.7 percentage points lower than that was produced before; but the yield reduction far outweighs this product quality gain. A single percentage point loss or gain in the plant yield for an coal mine operating with 1000 tph of raw coal, could result in the loss or gain in its annual revenue by more than $3 million based on a clean coal selling price of ~$45/ton.

Figure 3A:
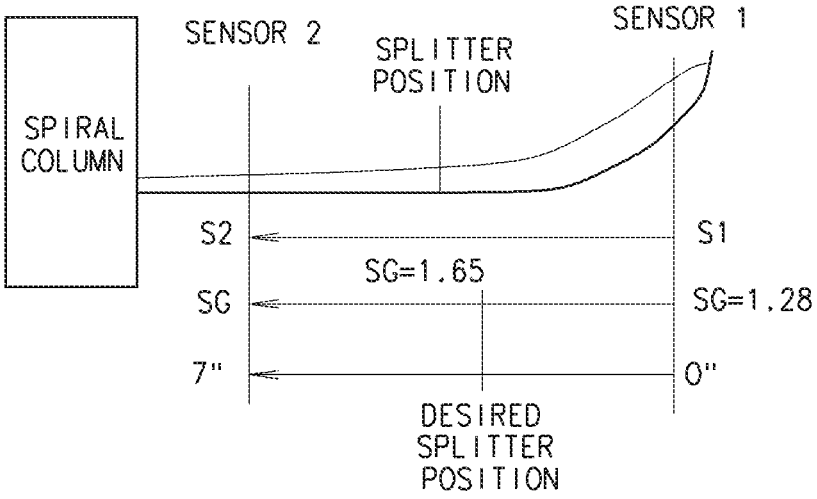
FIG. 3A is a diagram illustrating the splitter box.
Figure 3B:
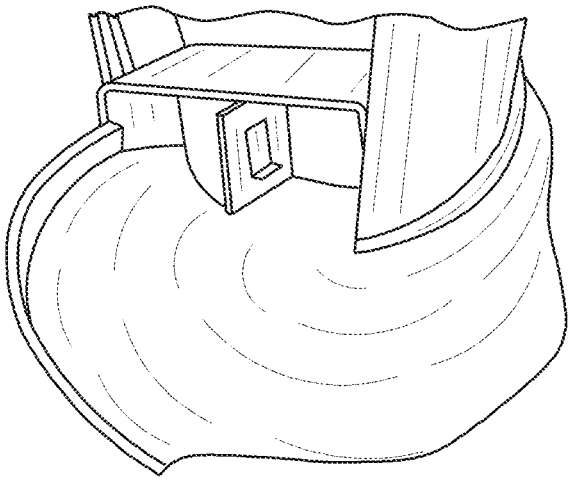
FIG. 3B is a splitter box position at the exit of a coal spiral.
Figure 3C:
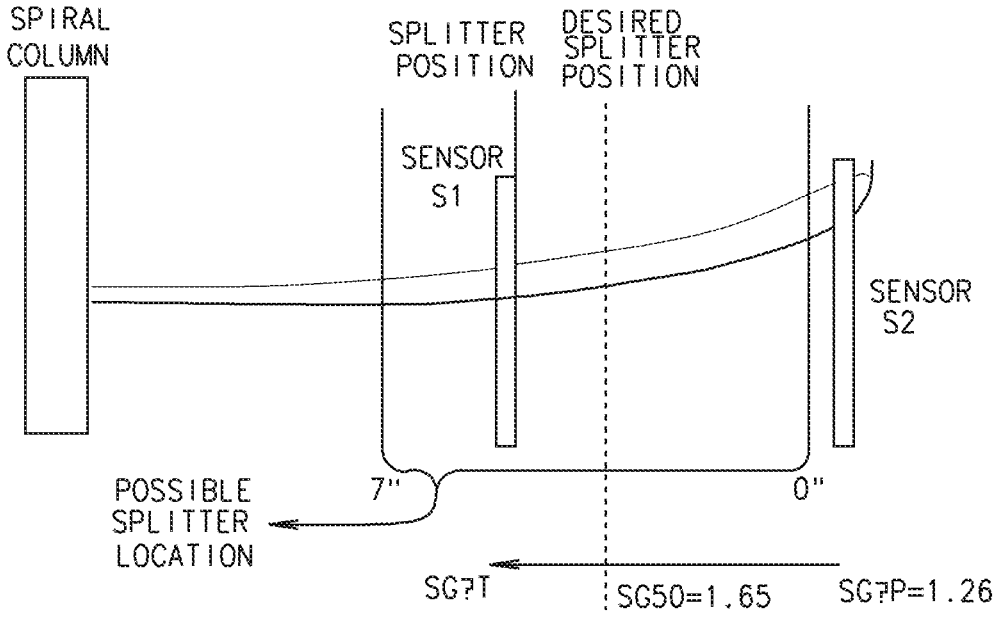
FIG. 3C is an illustration of a splitter box
Figure 3D:
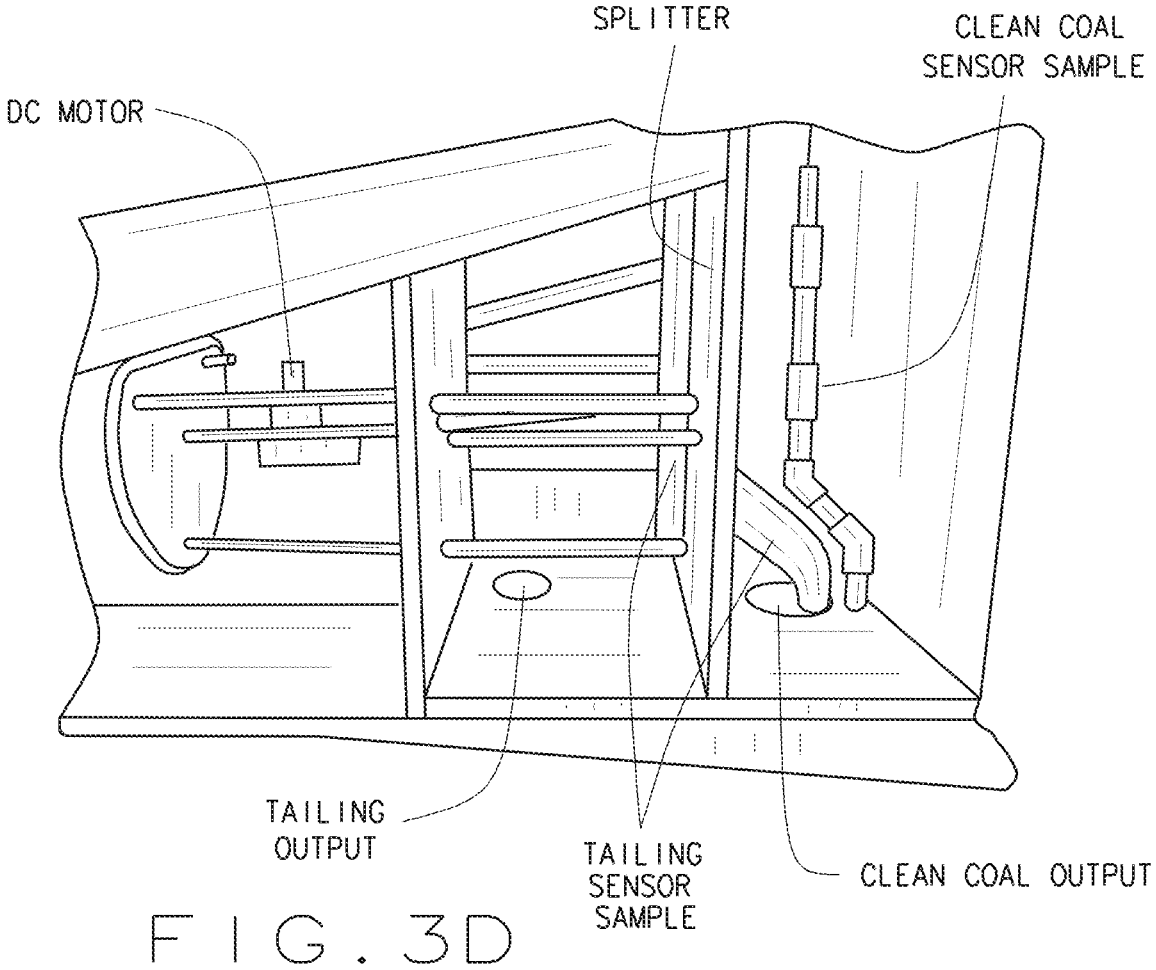
FIG. 3D is an illustration of a splitter box.
Figure 6:
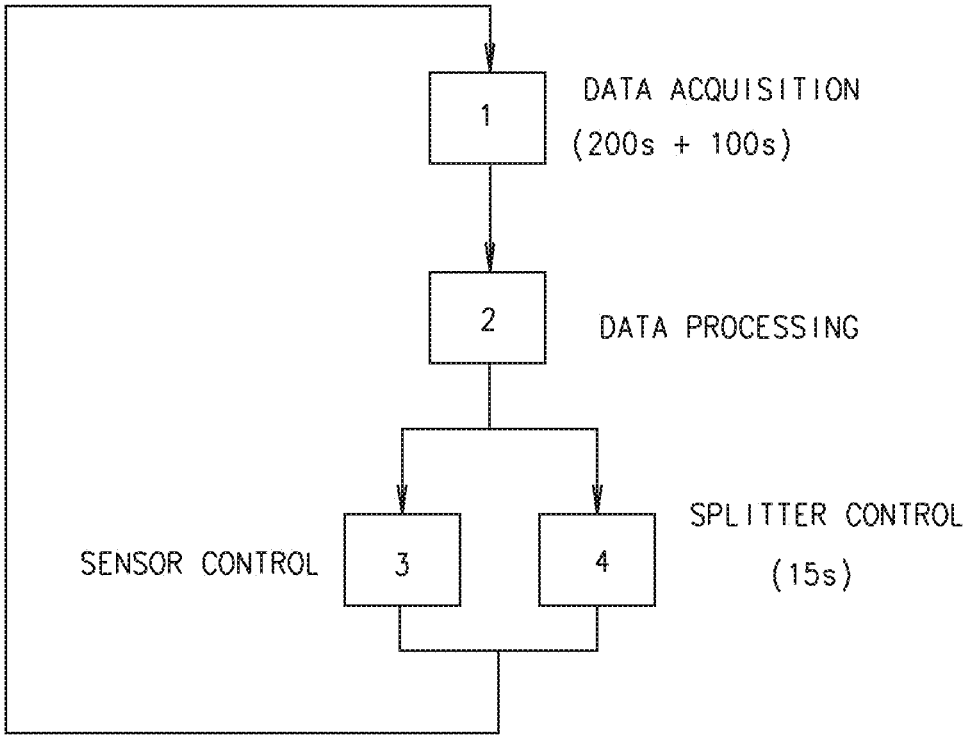
FIG. 6 is a diagram of the splitter control logic.

A schematic diagram showing the possible splitter positions in the critical area of the spiral trough is illustrated in FIGS. 3A to 3C. FIGS. 3C and 3D illustrate the sensor configuration when at least one sensor is attached to the splitter. FIG. 4 shows a view of the splitter box, which is the mechanical part of the SSC. FIGS. 5A to 5C show the view of the conductivity-based sensor tube, in one configuration, two of which are used in the SSC, as shown in FIG. 3A to 3E. In one implementation the sensors can include two approximately 1-inch diameter tubes. Each sensor tube can have two approximately 0.25-inch wide rings made of stainless steel located about approximately 0.75 inches apart. One of the rings inside each tube is used to send the input voltage to the packed material in the tube and the other ring can sense the current between the two spaced apart rings based on the conductivity of the packed bed of materials. FIG. 6 shows the basic diagram of the splitter control. The table in FIG. 7 shows the results obtained from 8 different tests obtained from a full-scale compound spiral attached with SSC. Each sensor can be connected to channels of the microcontroller, which can take the analog voltage coming from the sensors and convert it to a digital value. This digital value can then be converted into numerical values to serve as the output and the digital values can be stored in a memory. These values represent the conductivity of the packed bed of materials in the sensors; a higher value means higher conductivity.

The system can use a calibration equation defining the relationship between tailings and the difference between the two sensor readings to find the proper position for the splitter. To develop this equation, a splitter box can be modified with piping to capture a clean coal and three tailings samples. The clean coal sample collector can always feed the clean coal sensor, but the tailings sensor could be fed by any one of the three tailings sample collectors, each positioned in a different location (named 'a,' 'b,' and 'c') along the spiral edge where the splitter moves. After reading the sensor outputs in the field, clean coal and tailings samples are collected and analyzed for SG and ash content. Results will show that clean coal density varies, for example from about approximately 1.24 to about approximately 1.29 with an average of about approximately 1.26. Knowing this value, the density gradient across the critical separation zone of the spiral trough can be established based on the difference between clean coal and tailings readings.

Figure 1C:
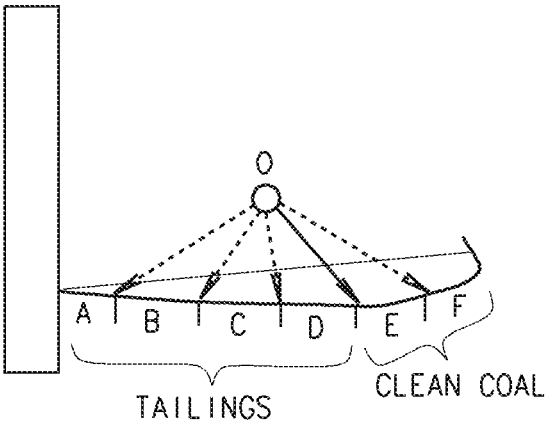
FIG. 1C is an illustration of the spiral separation.
Figure 1E:
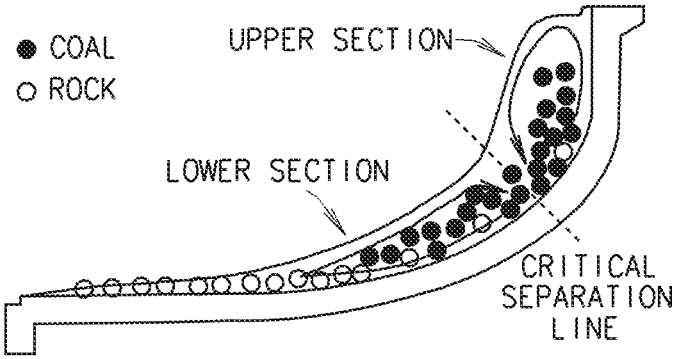
FIG. 1E is an illustration of the flow pattern within the spiral cross section.
Figure 1B:
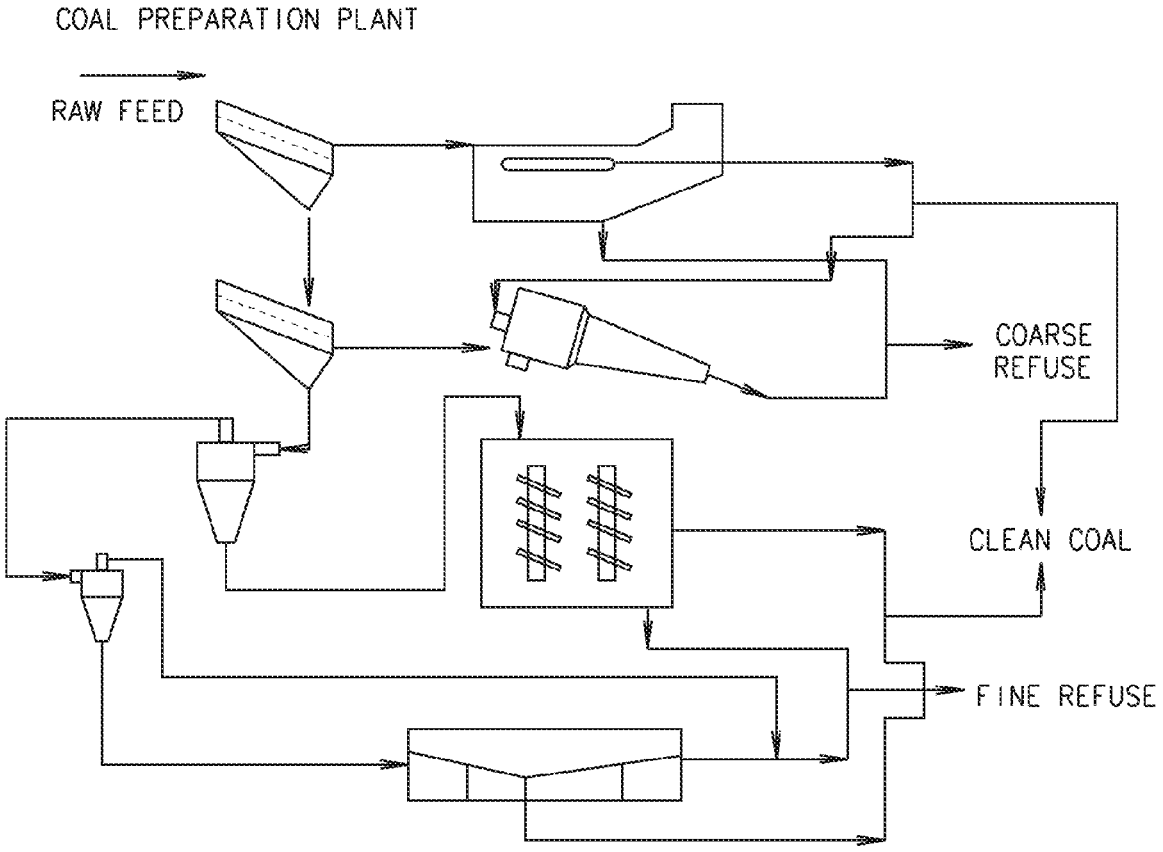
FIG. 1B is an illustration of a coal processing plant including coal spirals.
Figure 1D:
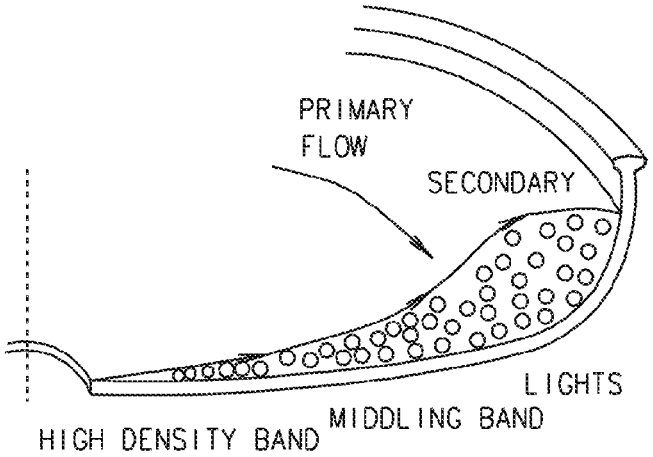
FIG. 1D is an illustration of the separation principle of the spiral process.

Referring to FIG. 1B, an illustration of a coal preparation plant is provided. The raw feed is channeled through the coal spiral, which provides for separation of the coal into separate product streams. See FIG. 1A, which is an illustration of a coal spiral. See FIG. 1D, which illustrates the separation that occurs when the raw feed is channeled through the coal spirals. There are usually two splitters at the discharge end of a coal spiral to produce three product streams (i.e. clean coal product, middlings, and tailings respectively). Spiral concentrators are used in coal preparation plants to clean 1 mm×150 micron particle size coal fraction, which is too fine to be effectively cleaned by a heavy medium cyclone, but too coarse for froth flotation cells or flotation columns. The device as described and claimed herein is attached to the coal spirals in the plant. FIG. 1C is an illustration of using the automated system to adjust the splitter where the solid arrow represents the original splitter position, whereas the dotted arrows represent the various possible positions of the splitter. However, the motor can be operable to effect movement of the splitter to provide for many more possible positions. FIG. 2 is an illustration of why there is a need for the automated adjustment method and system for dynamically adjusting the spiral splitter position in real-time.

Figure 10A:
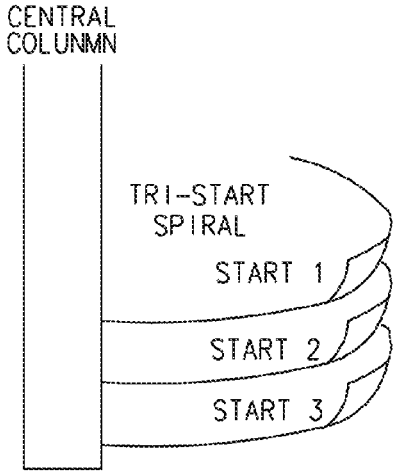
FIG. 10A is an illustration of a triple start spiral.
Figure 10B:
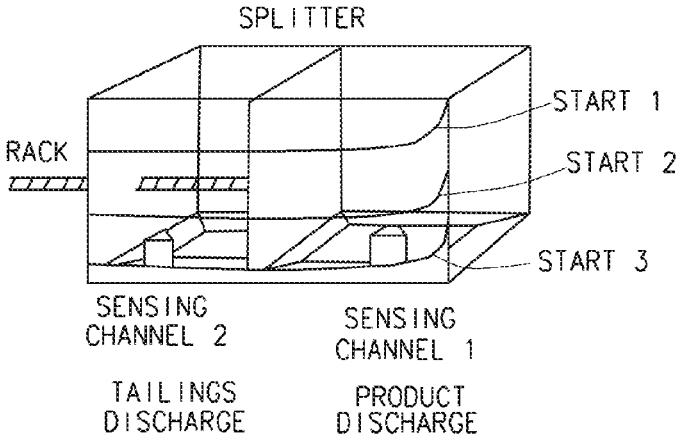
FIG. 10B is an illustration of a splitter box.
Figure 11:
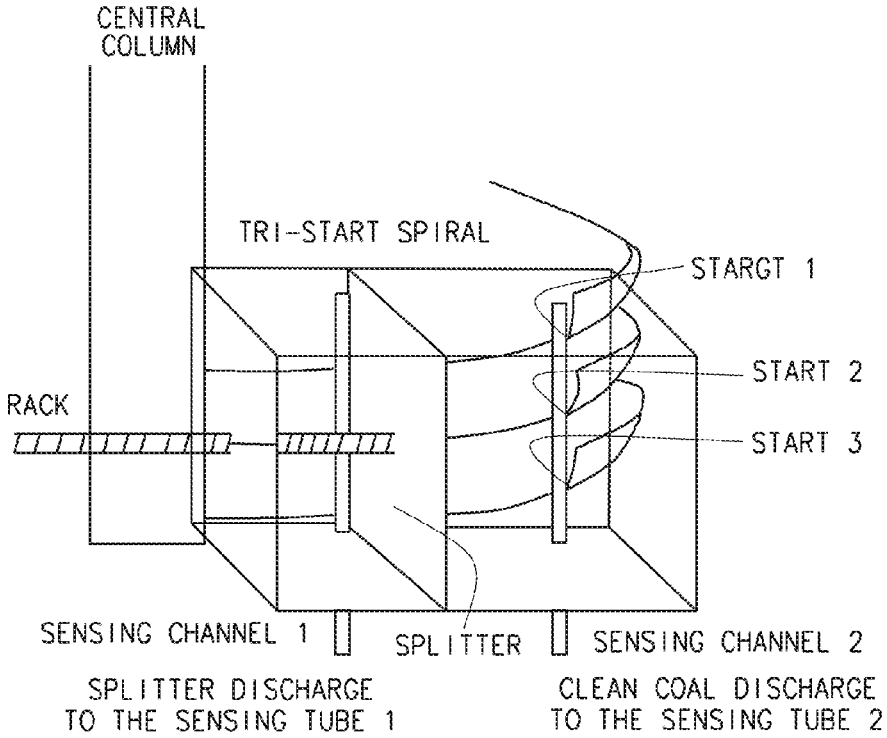
FIG. 11 is an illustration of a splitter box for a triple start spiral.

FIGS. 3A to 3D is an illustration representative of the splitter being adjusted to a desired position based on the readings of the two sensors configuration (Sensor 1 and Sensor 2). The sensors can be electrical conductivity sensors used to sense the solids density of particles in the spiral trough, where the sensor establishes a density gradient in the critical region across the spiral trough at the discharge end (exit end) and further adapted for outputting a density gradient reading, which can be received by a controller for, which controls movement of the splitter. FIG. 3B is an illustration of the splitter box installed using the device as described and claimed herein. FIGS. 10A and 10B and 11 is an illustration of a splitter box installed on a triple-start spiral concentrator.

Figure 8:
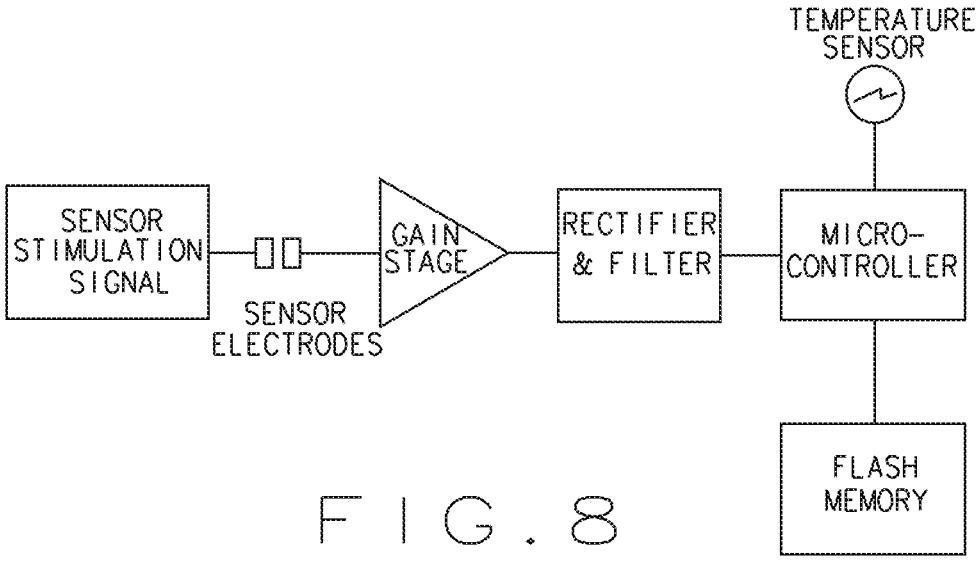
FIG. 8 is an illustration of SSC sensor.

FIG. 4 illustrates the SSC installed on a full scale spiral, and FIGS. 5A to 5C illustrates the conductivity sensor tube/probe. FIG. 8 is an illustration of a basic block diagram for the system data acquisition occurs from the sensors and is received by the controller were data processing occurs. The data is interpreted and a sensor control and splitter control signals are determined and transmitted. The splitter control signal is received by the motor control, for example the servo motor control, which changes the position of the splitter based on the splitter control signal and need. FIG. 8 provides a more detailed configuration for a sensor system.

A micro-controller (for example a PIC24) can continuously monitor the two outputs of the two sensors and determine the differential and instruct the motor to adjust the splitter accordingly. The position of the splitter can be controlled and varied by the motor as illustrated in FIG. 1C. The readings from the sensors can be monitored in real-time. The micro controller and control circuitry can also be in communication with a computer system, for example, a UART or USB port or hyperterminal program or various wireless connections (Bluetooth, zigbee, Wi-Fi, etc). The computer system can be programmed to provide a graphical user interface to set up communications between the computer system and the micro controller and control circuitry, set up the sensor channels, set up the communication link with the motor and can collect and store data whether data relating to the sensors illustrative of the product flow or data relating to the control of the splitter including the position data and time stamp of the position adjustment. The computing system can be programmed to correlate and plot the data. Again in other configurations of the SSC more than two sensors can be used or a single sensor can be used.

Extra memory in the form of a 16-Mbit flash cell can be added to the sensor circuit for logging system operations, which captures valuable data for system debugging and performance analysis. This flash memory can contain 4,096 pages and each page can contain 528 bytes. The memory can be communicably linked with the microcontroller via a SPI. In one implementation of the microcontroller program, the first eight pages can be reserved for memory management and other purposes leaving 4,088 pages for storing 212,576 (4,088×52) log entries. With 5-minute cycle times, this amount of memory can record system operations 24 hours per day for almost two years.

Figure 9A:
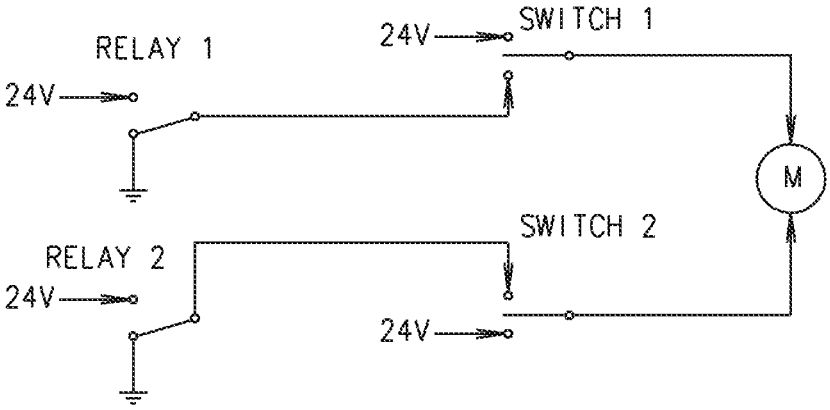
FIG. 9A is an illustration of motor control switches.

Occasionally system operators may need to manually control the motor that adjusts the splitter position. To accommodate this, two additional switches can be added to the motor control circuit as shown in FIG. 9A. An additional switch can be added to allow users to control both sensor tube solenoids without turning on the PCB. This is a two-position switch whose function is described in the table in FIG. 9B. It should be noted that the solenoid control switch should not be in Position 2 if the PCB is on because the manual control will override the PCB control. Adding manual control switches not only provides additional operational flexibility, but also separates the PCB from high voltage components, thus improving system reliability.

In one implementation a large splitter box can be configured to fit on the discharge end of a triple-start spiral set (three spiral units on the same foot print) as illustrated in FIGS. 10 and 11. The splitter box can include a housing, a splitter gate, a gear rack driven by a DC motor, and two sensing channels. The splitter gate serves all three spiral starts dividing their flow into product and tailings.

Figure 12:
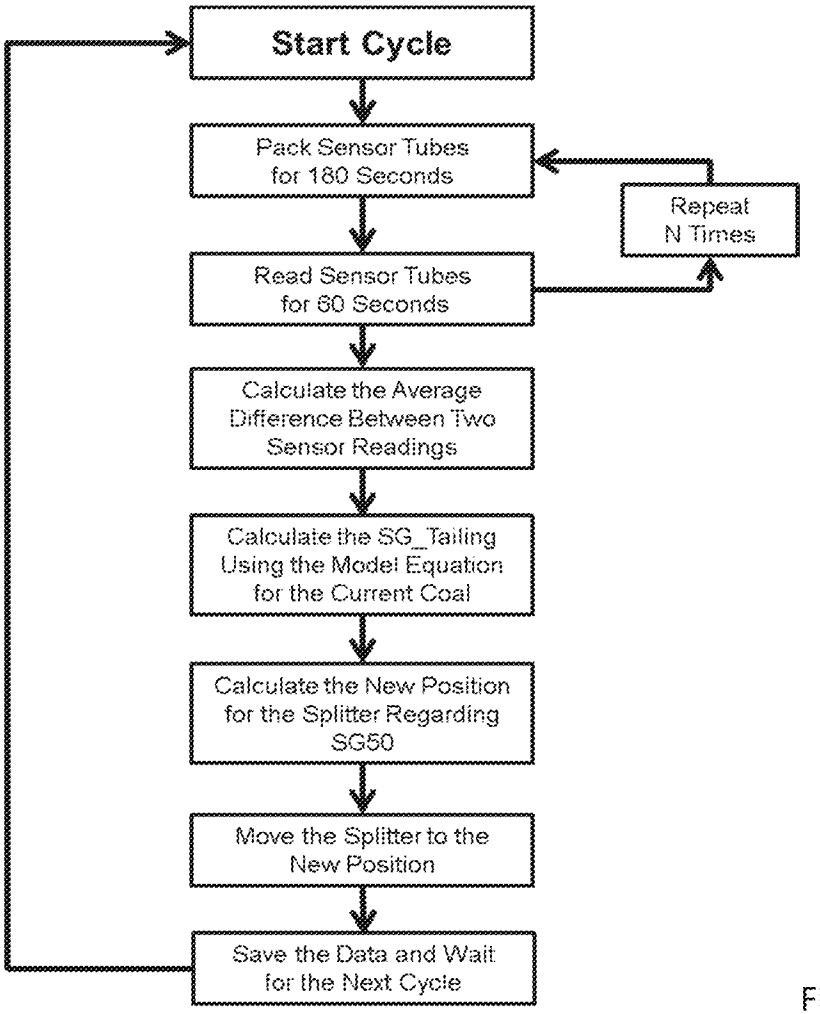
FIG. 12 is an illustration of a testing cycle algorithm.

For one implementation the testing cycle algorithm for adjusting the splitter position is given in FIG. 12. After packing the sensor tubes for 180 seconds, the PCB starts reading for 60 seconds and gives the difference between two clean coal and tailings sensor readings. This cycle can be repeated several times and readings averaged for more reliable data. Then, the PCB calculates the tailings SG from the calibration equation. The clean coal sensor sample collector position, which is fixed at the clean coal section of the spiral, was assumed to be the reference point for measuring distances. The splitter could move through approximately a 7-inch span starting at two inches and going to approximately nine inches from the fixed clean coal sampling point toward the tailings section.

In yet another implementation, in order to address less accurate sensor reading due to higher tailings SG, the tailings sensor sample collector can be attached to the splitter where the sample density would be much less than the overall tailings sample density, and it would be close to the desired density cut point of the spiral as it is always moving with the splitter. This splitter box configuration, is illustrated in the FIG. 11.

The various SSC examples shown above illustrate a sensor and control system to automatically adjust the product splitter position of a full-scale coal spiral. A user of the present technology may choose any of the above embodiments, or an equivalent thereof, depending upon the desired application. In this regard, it is recognized that various forms of the subject SSC could be utilized for coal or any other mineral applications without departing from the present invention.

The various implementations and examples shown above illustrate a method and system for automating a splitter control for a coal spiral. A user of the present method and system may choose any of the above implementations, or an equivalent thereof, depending upon the desired application. In this regard, it is recognized that various forms of the subject SSC method and system could be utilized for coal or any other mineral application without departing from the spirit and scope of the present implementation.

As is evident from the foregoing description, certain aspects of the present implementation are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present implementation. Accordingly, the specification and drawings are to be regarded in an illustrative rather than a restrictive sense.

Certain systems, apparatus, applications or processes are described herein as including a number of modules. A module may be a unit of distinct functionality that may be presented in software, hardware, or combinations thereof. When the functionality of a module is performed in any part through software, the module includes a computer-readable medium. The modules may be regarded as being communicatively coupled. The inventive subject matter may be represented in a variety of different implementations of which there are many possible permutations.

The methods described herein do not have to be executed in the order described, or in any particular order. Moreover, various activities described with respect to the methods identified herein can be executed in serial or parallel fashion. In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

In an example embodiment, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may be a server computer, a client computer, a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine or computing device. Further, while only a single machine is illustrated, the term "machine" shall also be taken to include any collection of machines that individually or jointly execute a set (or multiple sets) of instructions to perform any one or more of the methodologies discussed herein.

The example computer system and client computers include a processor (e.g., a central processing unit (CPU) a graphics processing unit (GPU) or both), a main memory and a static memory, which communicate with each other via a bus. The computer system may further include a video/graphical display unit (e.g., a liquid crystal display (LCD) or a cathode ray tube (CRT)). The computer system and client computing devices also include an alphanumeric input device (e.g., a keyboard), a cursor control device (e.g., a mouse), a drive unit, a signal generation device (e.g., a speaker) and a network interface device.

The drive unit includes a computer-readable medium on which is stored one or more sets of instructions (e.g., software) embodying any one or more of the methodologies or systems described herein. The software may also reside, completely or at least partially, within the main memory and/or within the processor during execution thereof by the computer system, the main memory and the processor also constituting computer-readable media. The software may further be transmitted or received over a network via the network interface device.

The term "computer-readable medium" should be taken to include a single medium or multiple media (e.g., a centralized or distributed database, and/or associated caches and servers) that store the one or more sets of instructions. The term "computer-readable medium" shall also be taken to include any medium that is capable of storing or encoding a set of instructions for execution by the machine and that cause the machine to perform any one or more of the methodologies of the present implementation. The term "computer-readable medium" shall accordingly be taken to include, but not be limited to, solid-state memories, and optical media, and magnetic media.

Other aspects, objects and advantages of the present invention can be obtained from a study of the drawings, the disclosure and the appended claims.

What is claimed is:

1. An apparatus for controlling a splitter of a spiral concentrator comprising:

a spiral concentrator having a splitter attached at a discharge end of the spiral concentrator, where said splitter has a splitter position that is variable;

a constituent solid density sensor sensing characteristics of a constituent solid density of a slurry channeled through the spiral concentrator where the slurry is selected from a group consisting of a mineral slurry and a coal slurry, and said sensor having a constituent solid density gradient output signal indicative of a constituent solid density gradient across a spiral trough of the spiral concentrator based on the sensed characteristics;

a microcontroller configured to receive the constituent solid density gradient output signal indicative of the constituent solid density gradient across the spiral trough of the spiral concentrator and the microcontroller configured with program logic to interpret the constituent solid density gradient output signal indicative of the constituent solid density gradient and calculate a specific gravity of separation and correlate the specific gravity of separation to a splitter position along the spiral trough to achieve the specific gravity separation for the slurry channeled through the spiral concentrator and where said microcontroller having an output motor control signal representative of the splitter position; and a motor having a motor controller configured to receive the output motor control signal and controlling the motor to move a splitter to the splitter position along the spiral trough responsive to the motor control signal thereby separating the slurry channeled through the spiral concentrator at the specific gravity of separation.

2. The apparatus as recited in claim 1, where the constituent solid density sensor is an electrical conductivity sensor and where the sensing of characteristics of the constituent solid density of the slurry channeled through the spiral concentrator is measuring an electrical conductivity of the slurry and where the constituent solid density gradient output signal indicative of the constituent solid density is based on the electrical conductivity measurement.

3. The apparatus as recited in claim 2, where the constituent solid density sensor includes at least two electrical conductivity sensors space apart across the spiral trough.

4. The apparatus as recited in claim 3, where each of the at least two electrical conductivity sensors comprise at least two sampling tubes where each sampling tube has two spaced apart conductive rings positioned inside each of the sampling tubes and attached along an interior wall of each sampling tube and where one of the two spaced apart conductive rings in each of the sampling tubes sends an input voltage to a sample of the slurry within each of the sampling tubes and the other of the two spaced apart conductive rings in each of the sampling tubes senses a current between the two spaced apart conductive rings based on the conductivity of the sample of the slurry.

5. The apparatus as recited in claim 4, where the at least two sampling tubes are spaced across the spiral trough of the spiral concentrator at an exit of the spiral concentrator.

6. The apparatus as recited in claim 5, where at least one of the at least two sampling tubes is attached to the splitter.

7. The apparatus as recited in claim 5, where at least two of the at least two sampling tubes are positioned on opposing sides of the splitter, one with respect to the other.

8. The apparatus as recited in claim 2, where the microcontroller is configured to control a control circuit having additional sensor inputs including one or more of temperature sensor inputs, vibration sensor inputs and humidity sensor inputs.

9. The apparatus as recited in claim 8, where the microcontroller and the control circuit is configured with control logic to adjust the constituent solid density gradient output signal indicative of the constituent solid density gradient based on one or more of the additional sensor inputs.

10. The apparatus as recited in claim 9, further comprising:

a user interface having a program logic interface to set up communications between the microcontroller and control circuitry, to set up sensor channels, to set up a communication link with the motor and to collect and store data whether data relating to the electrical conductivity sensor illustrative of a product flow or data relating to control of the splitter including position data and time stamp data and position adjustment data.

* * * * *